US006732535B2

(12) United States Patent
Boucher

(10) Patent No.: US 6,732,535 B2
(45) Date of Patent: May 11, 2004

(54) DEVICE FOR CLOSING AND CONNECTING TO EXTERNAL CONDUITS A RESERVOIR OF CRYOGENIC FLUID, AND RESERVOIR PROVIDED WITH SUCH A DEVICE

(75) Inventor: Guillaume Boucher, Nogent sur Marne (FR)

(73) Assignee: L'Air Liquide - Societe Anonyme a Directoire et Conseil de Surveillance pour l'Etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 10/049,238

(22) PCT Filed: May 7, 2001

(86) PCT No.: PCT/FR01/01391

§ 371 (c)(1),
(2), (4) Date: May 9, 2002

(87) PCT Pub. No.: WO02/090822

PCT Pub. Date: Nov. 14, 2002

(65) Prior Publication Data

US 2002/0162340 A1 Nov. 7, 2002

(51) Int. Cl.[7] ..... F17C 7/04
(52) U.S. Cl. ..... 62/48.1; 62/51.1

(58) Field of Search ..... 62/48.1, 51.1

(56) References Cited

U.S. PATENT DOCUMENTS

| | | | | | |
|---|---|---|---|---|---|
| 2,044,670 | A | * | 6/1936 | Dana | 62/48.1 |
| 2,158,458 | A | * | 5/1939 | Mathis et al. | 62/48.1 |
| 2,502,588 | A | * | 4/1950 | Preston et al. | 62/48.1 |
| 3,588,312 | A | * | 6/1971 | Burnier et al. | 62/51.1 |
| 4,625,753 | A | * | 12/1986 | Gustafson | 137/202 |
| 4,956,975 | A | | 9/1990 | Gustafson | |
| 5,711,354 | A | | 1/1998 | Siegele et al. | |
| 5,869,746 | A | | 2/1999 | Watanabe et al. | |
| 5,974,827 | A | * | 11/1999 | Hosking et al. | 62/468 |
| 5,975,121 | A | | 11/1999 | Arzenton et al. | |

* cited by examiner

*Primary Examiner*—Ronald Capossela
(74) *Attorney, Agent, or Firm*—Young & Thompson

(57) ABSTRACT

The device comprises a monobloc subassembly (1) of cast stainless steel comprising a principal portion in the form of a disc (4) mounted on a collar (2) of the reservoir (3) and defining at least two channels (8, 9) for the passage of fluid, typically for filling, communication with the atmosphere, and withdrawal of liquid and gaseous phases reheated by atmospheric reheaters (23; 30) for the supply (31) of a controlled gaseous flow.

Application particularly to cryogenic reservoirs for medical oxygen for oxygen therapy.

5 Claims, 2 Drawing Sheets

DEVICE FOR CLOSING AND CONNECTING TO EXTERNAL CONDUITS A RESERVOIR OF CRYOGENIC FLUID, AND RESERVOIR PROVIDED WITH SUCH A DEVICE

FIELD OF THE INVENTION

The present invention relates to reservoirs for cryogenic fluid and more particularly devices for closing and connecting to external conduits such reservoirs.

BACKGROUND OF THE INVENTION

Known devices for closing and connecting reservoirs of cryogenic fluid are constituted by a mechanical-welded assembly of a closure plate and connection pieces machined and fixed, typically by welding, in openings machined in the closure plate. This technique is particularly cumbersome, because of the number of different pieces to be produced, stored and assembled, and the large amount of scrap resulting from problems of machining and welding constitute materials, typically austenitic stainless steels.

SUMMARY OF THE INVENTION

The present invention has for its object to provide a device of simplified structure permitting overcoming most of these problems and greatly reducing the cost of production and assembly.

To do this, the invention provides a device comprising a monobloc subassembly of cast stainless steel, typically produced by lost wax molding, defining at least two, typically at least three channels for the passage of fluid.

According to a more particular characteristic of the invention, the monobloc subassembly is made by molding from an austenitic stainless steel alloy comprising at least 16%, typically between 16 and 18.5% chromium, and at least 10%, typically between 10 and 10.13% nickel, and having, in the liquid phase, a ferrite content greater than 2%, preferably not exceeding 6%.

The present invention also has for its object a reservoir for cryogenic fluid, particularly liquid oxygen for household oxygen therapy, provided with such a device and typically provided with two atmospheric reheaters connected to outlet passages for the liquid and gas of the device.

BRIEF DESCRIPTION OF THE DRAWINGS

Other advantages and characteristics of the present invention will become apparent from the following description of one embodiment, given by way of illustration but in no way limiting, with respect to the accompanying drawings, in which.

DETAILED DESCRIPTION OF THE INVENTION

Figure 1:
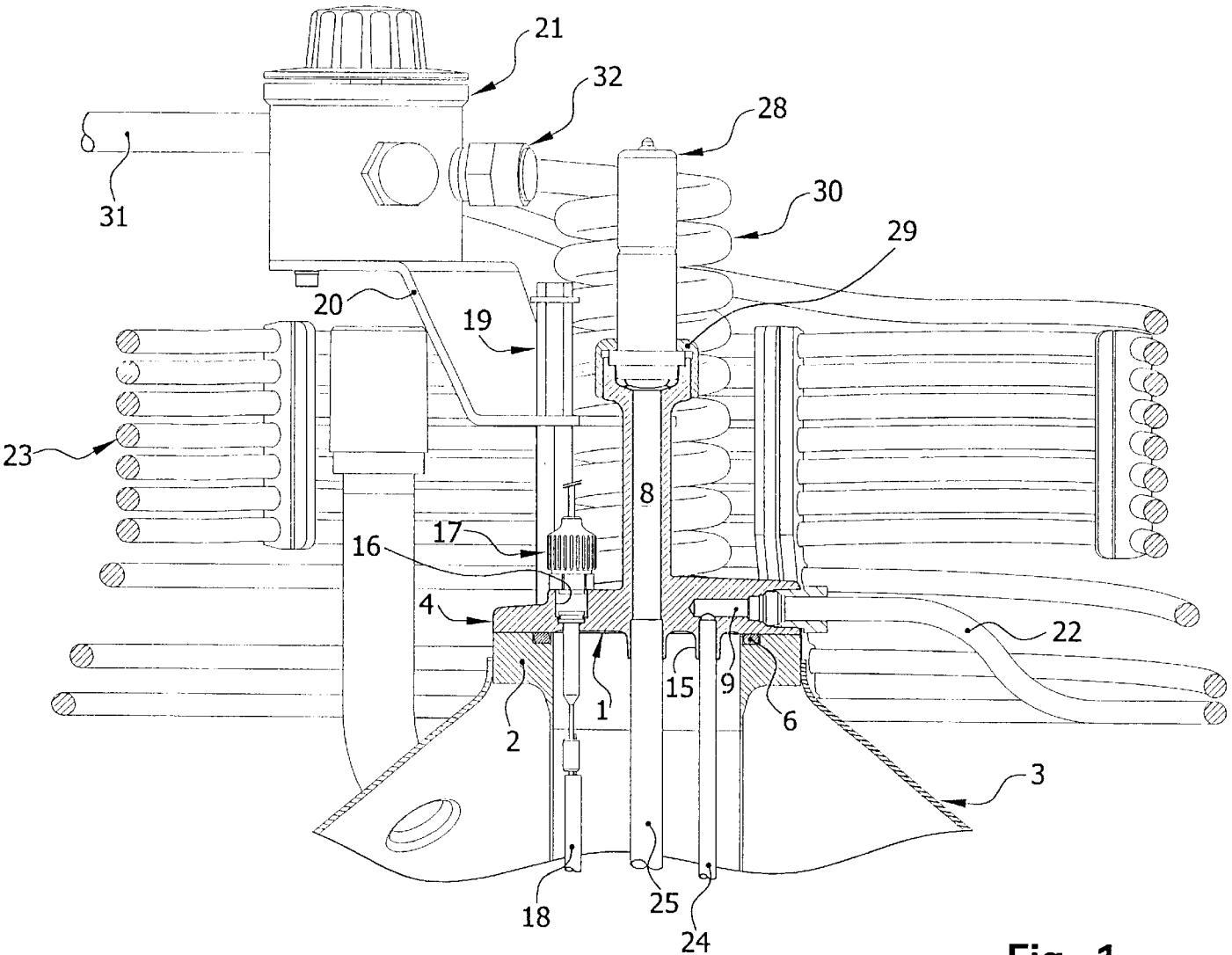
FIG. 1 is a schematic view in vertical cross-section of the upper portion of a cryogenic reservoir for oxygen therapy, provided with a device according to the invention.

In FIG. 1, there is shown a device according to the invention in place on a neck collar 2 mounted in the neck of a cryogenic reservoir 3.

According to one aspect of the invention, the device according to the invention comprises a monobloc subassembly 1 made of cast stainless steel comprising essentially a principal portion in the form of a disc 4 having a lower transverse surface forming a joint plane 5 mounted flat against the collar 2 and provided with an O ring 6.

The subassembly 1 comprises a central chimney 7 orthogonal to the disc 4, substantially coaxial to this latter, and defining a central passage 8. In the principal portion 4 are defined, by projections on the surface opposite the joint plane 5, a first transverse channel 9, a second transverse channel 10 orthogonal to the preceding one, and a third transverse channel 11 in the plane of channel 10 and diametrically opposite this latter.

The channel 10 opens through the lower part of the disc 4 in a cavity 12 whilst the channel 11 itself opens through a portion of channel 13 formed in a portion of the projecting shoulder 14 through which also opens downwardly the central channel 8. The channel 9 similarly opens downwardly through a portion of a channel formed in a projecting shoulder 15.

As seen in FIG. 1, opposite the channel 9 is an axial channel 16 passing through the disc 4 receiving a piece 17 permitting the electrical connection to a capacitative level gauge 18.

The monobloc subassembly 1 is mounted on the collar 2 by three angularly spaced screws (not shown) and by a column 19 with a screwthreaded lower end also serving, via a support plate 20, to support a flow rate control valve housing 21, as will be seen later.

As is seen in FIG. 1, in the assembled condition, the channel 9 receives the upstream end 22 of an atmospheric reheating coil 23, as described in French patent application FR 99 13617, the portion of the channel in the shoulder 15 receiving the end of a dipping tube 24 extending to adjacent the bottom of the interior of the receptacle of the reservoir 3. Similarly, a dipping tube 25 is mounted in the lower end of the channel 8. This latter is prolonged upwardly by a recess formed in a head 26 of enlarged diameter comprising an external screwthread 27 and receiving the lower end of a one-way filling connection 28 held in place on the chimney 7 by a nut 29 coacting with the screwthread 27.

To the transverse channel 10 is connected the upstream end of an atmospheric reheating coil 30 whose downstream end is connected to the above-mentioned valve housing 21. The channel 11 is itself externally connected to a valve communicating with the open air (not shown).

The use of the described device is the following: the filling with liquefied fluid, of the reservoir 3, takes place at a low pressure, about 3 bars, through the one-way connection 28, the channel 8 and the tube 25, the internal volume of the reservoir being, during this operation, in communication with the ambient atmosphere via the channels 13 and 11 and the valve connecting with the open air downstream of this latter. Typically an overflow tube (not shown) extending into the reservoir, is brazed into the channel 13 to limit the height of liquid in the reservoir. In use, the removal of cryogenic fluid in liquid phase contained in the reservoir, pressurized by the gaseous overhead in the reservoir, takes place through the tube 24, the channel 9 and the coil 23 before reaching the flow rate control valve housing 21 supplying, at its outlet 31, a gaseous flow at a controlled flow rate toward the user. The removal of the gaseous phase in the reservoir 3 takes place through the channel 10 and the coil 30 before rejoining the valve housing 21, provided with at least one safety overpressure valve 32.

Figure 2:
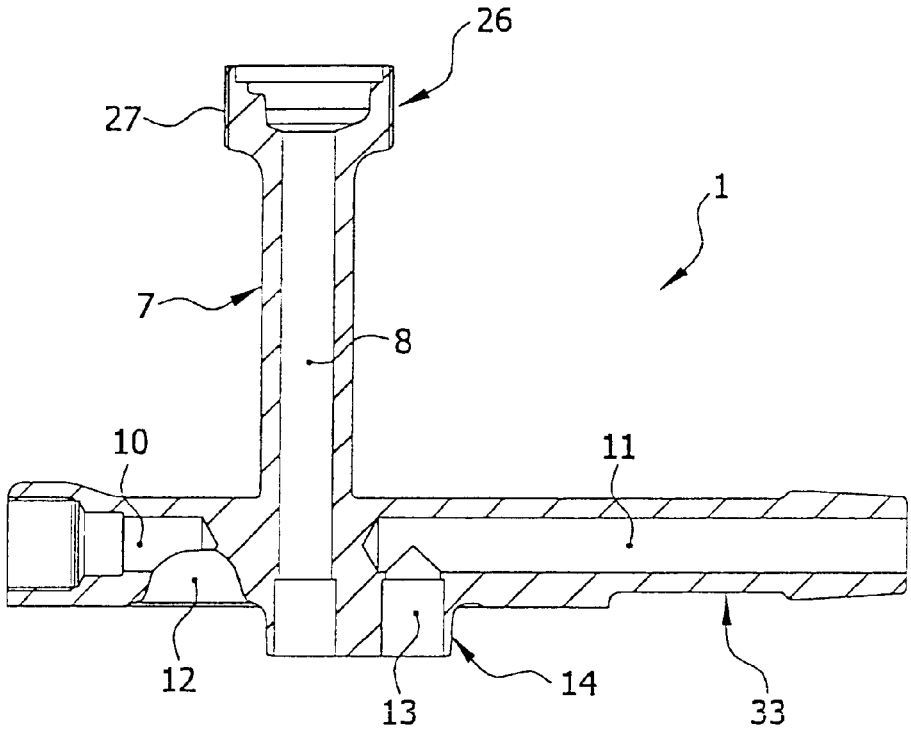
FIG. 2 is a cross-sectional view of the device of FIG. 1 in a plane perpendicular to the plane of FIG. 1.
Figure 3:
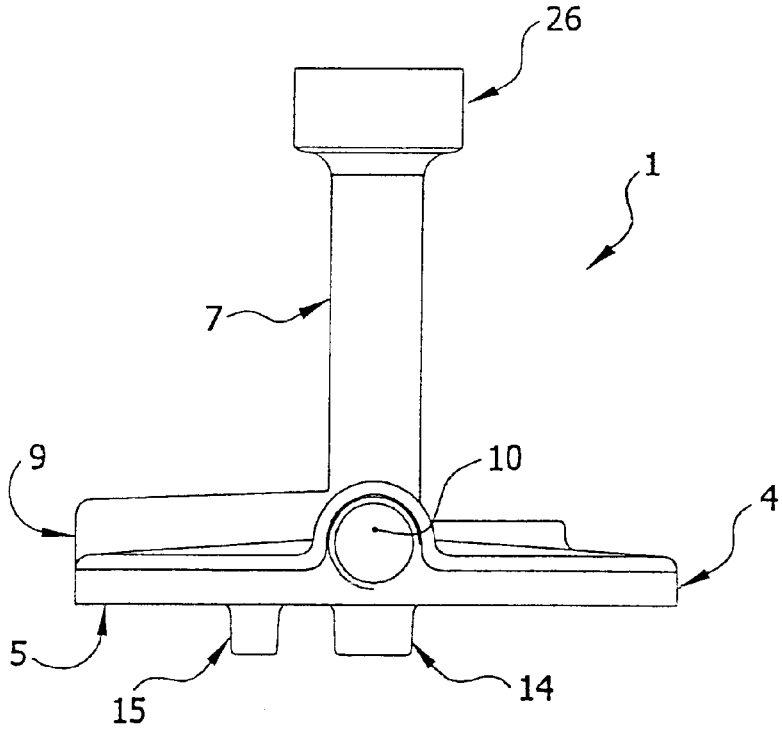
FIG. 3 is a left side view of the device of FIG. 2.

As is seen in FIG. 1, the liquid outlet channel 9 is disposed opposite the passage 16 for mounting the probe 18 such that the withdrawal of the liquid takes place with a minimum of transmission of cold to the crossing 17 of the probe 18. Similarly, as is seen in FIG. 2, the channel 11 is prolonged beyond the disc 4 by a transverse tubular extension 33 permitting spacing the valve that communicates with the open air, from the disc 4, and hence avoiding excessive chilling of this valve.

In a preferred embodiment, the subassembly 1 is made by lost wax molding, which substantially avoids machining operations, from stainless steel comprising at least 16% of chromium and at least 10% of nickel, typically a stainless steel billet of the 316L type which, after casting, has a ferrite content greater than 2%, typically between 2 and 6%, which is obtained by an addition of chrome to the bath of molten metal.

What is claimed is:

1. Device for closing and for connecting to external conduits of a reservoir of cryogenic fluid, the device comprising a monobloc subassembly of cast stainless steel; said cast subassembly defining at least three channels for the passage of fluid, said device further comprising a through passage for mounting a crossing or a level gauge.

2. The device according to claim 1, wherein the cast subassembly defines a central filling passage, a liquid outlet passage and a gas outlet passage.

3. Cryogenic reservoir for storing a cryogenic fluid, the reservoir having a neck collar and being provided with a device mounted in the neck collar for closing and connecting to external conduits of the cryogenic reservoir; said device comprising a monobloc subassembly of cast stainless steel; said cast subassembly defining at least three channels for the passage of fluid; said cryogenic reservoir further comprising two atmospheric reheaters connected respectively to outlet passages for liquid and for gas.

4. The cryogenic reservoir according to claim 3, wherein said cryogenic reservoir contains liquid oxygen.

5. Device for closing and for connecting to external conduits of a reservoir of cryogenic fluid, the device comprising a monobloc subassembly of cast stainless steel; said cast subassembly defining at least two channels for the passage of fluid; and said subassembly being made by lost wax casting of an austenitic stainless steel comprising at least 16% chromium and at least 10% nickel having, in liquid phase, a quantity of ferrite greater than 2% and not exceeding 6%.

* * * * *